US006508449B2

(12) United States Patent
Veazey

(10) Patent No.: US 6,508,449 B2
(45) **Date of Patent: *Jan. 21, 2003**

(54) THREE DIMENSIONAL WALL MOUNTED STRIPING SYSTEM

(76) Inventor: Robert M. Veazey, 1818 S. Meridian, Wichita, KS (US) 67213

( * ) Notice: Subject to any disclaimer, the term of this patent is extended or adjusted under 35 U.S.C. 154(b) by 0 days.

This patent is subject to a terminal disclaimer.

(21) Appl. No.: 09/728,863

(22) Filed: Dec. 4, 2000

(65) Prior Publication Data

US 2001/0030273 A1 Oct. 18, 2001

Related U.S. Application Data

(60) Provisional application No. 60/173,118, filed on Dec. 27, 1999.

(51) Int. Cl.[7] ..... A47F 7/14

(52) U.S. Cl. ..... 248/475.1; 211/87.01

(58) Field of Search ..... 248/475.1, 477, 248/488, 227.2, 244; 403/231, 401, 402; 211/87.01, 162, 94.02, 94.5

(56) References Cited

U.S. PATENT DOCUMENTS 3,270,474 A * 9/1966 Driggers ..... 52/395
3,321,878 A * 5/1967 Brown et al. ..... 52/211
4,691,392 A * 9/1987 Whitney ..... 4/595
4,917,528 A * 4/1990 Shewchuk ..... 403/231
5,138,759 A * 8/1992 Gruetzmacher ..... 29/467
5,224,610 A * 7/1993 Veazey ..... 211/87
5,297,589 A * 3/1994 Baumann ..... 139/91

* cited by examiner

*Primary Examiner*—Leslie A. Braun
*Assistant Examiner*—A. Joseph Wujciak
(74) *Attorney, Agent, or Firm*—Edwin H. Crabtree; Ramon L. Pizazzo; Donald W. Margolis

(57) ABSTRACT

A three dimensional, snap together striping system used for mounting on a wall and displaying various types of graphics. The striping system includes broadly a wall bracket, a first profile member and a second profile member. The wall bracket is adapted for mounting on a wall. The wall bracket includes an upper portion, a middle portion and a lower portion. The upper portion of the wall bracket includes a bracket hanger arm. The middle portion of the wall bracket includes a first bracket snap arm. The lower portion of the wall bracket includes a second bracket snap arm. The first profile member includes an upper portion having a first profile hanger arm which is used for releasably engaging the bracket hanger arm. The first profile member also includes a lower portion with a first profile snap arm. The first profile snap arm is used for releasably engaging the first bracket snap arm. The second profile member includes an upper portion having a second profile snap arm. The second profile snap arm is used for releasably engaging the second bracket snap arm. The second profile member also includes a lower portion having a second profile straight arm which rest against a portion of the wall. The first and second profile members include a display board bracket groove along the length of the first profile hanger arm and the second profile snap arm for releasably receiving a display board bracket mounted on the back of a display board.

14 Claims, 2 Drawing Sheets

THREE DIMENSIONAL WALL MOUNTED STRIPING SYSTEM

This application is based on a provisional patent application filed in the U.S. Patent and Trademark Office on Dec. 27, 1999 and having serial number 60/173,118.

BACKGROUND OF THE INVENTION (a) Field of the Invention

This invention relates to a business or a company display graphics and more particularly, but not by way of limitation, to a three dimensional wall mounted striping system for displaying a business or company name, a brand name, a logo, colors, trade dress, advertising, announcements and various other types of display graphics used by businesses dealing with customers and clients.

(b) Discussion of Prior Art

In U.S. Pat. No. 5,224,610 to the subject inventor, a similar three dimensional wall mounted striping system is disclosed having a wall bracket with snap arms for engaging and suspending two or more profile or rail members therefrom. The profile members include grooves therein for holding a hanger bracket. The hanger bracket is attached to the back of a display board which is used for displaying different types of graphics and business information.

The subject invention is similar in structure and function when compared to the above mentioned patented striping system, but the new wall mounted striping system includes substantial improvements and modifications which are described herein.

SUMMARY OF THE INVENTION

In view of the foregoing, it is a primary object of the subject invention to provide a new and improved three dimensional, snap together striping system and at a lower cost when compared to prior art striping systems.

Another object of the invention is to provide a three piece striping system that is attractive in appearance, rugged in construction, stream lined in design and can easily be installed by a single installer. Also, the system is easily removable, reusable and designed to cover fasteners used to attach the system to a wall or walls.

A further object of the stripping system is it can be quickly mounted on an existing wall or on existing walls for displaying a company or business name, a trademark or service mark, a logo, various colors, trade dress, announcements, advertising and other types of display graphics and related information.

Still another object of the invention is the system is made of strong rigid plastic, is color stable, can be cut to size without burred edges and comes in a variety of attractive color selections with a non-glare, matte finish surface.

Yet another object of the striping system, while described primarily for interior wall use, is the system can easily be adapted to a variety of surfaces for both interior and exterior use. Also, the system is semi-rigid to accommodate wall surface irregularities and includes profile end closure members and 90 degree bent inside and outside corner profile members for outside and inside corners of a wall when needed.

Another object of the invention is the striping system includes a wall bracket with a plurality of hanger and snap arms for receiving more than one profile member of different colors in a parallel and spaced relationship to each other for giving an overall attractive three dimensional appearance.

The subject three dimensional wall mounting striping system includes broadly a wall bracket, a first profile member and a second profile member. The wall bracket is adapted for mounting on a wall. The wall bracket includes an upper portion, a middle portion and a lower portion. The upper portion of the wall bracket includes a bracket hanger arm. The middle portion of the wall bracket includes a first bracket snap arm. The lower portion of the wall bracket includes a second bracket snap arm.

The first profile member includes an upper portion having a first profile hanger arm which is used for releasably engaging the bracket hanger arm. The first profile member also includes a lower portion with a first profile snap arm. The first profile snap arm is used for releasably engaging the first bracket snap arm.

The second profile member includes an upper portion having a second profile snap arm. The second profile snap arm is used for releasably engaging the second bracket snap arm. The second profile member also includes a lower portion disposed below a lower portion of the wall bracket. The lower portion of the second profile member includes a second profile straight arm. An edge along the length of the straight arm is used to rest against a portion of the wall.

The first and second profile members include first and second display board bracket grooves along the length of the first profile hanger arm and the second profile snap arm, The bracket grooves are used for releasably receiving a display board bracket mounted on the back of a display board. The front of the display board is used for display graphics and other types of business information.

These and other objects of the present invention will become apparent to those familiar with the different types of three dimensional display and striping systems when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DESCRIPTION OF THE PREFERRED EMBODIMENTS

Figure 1:
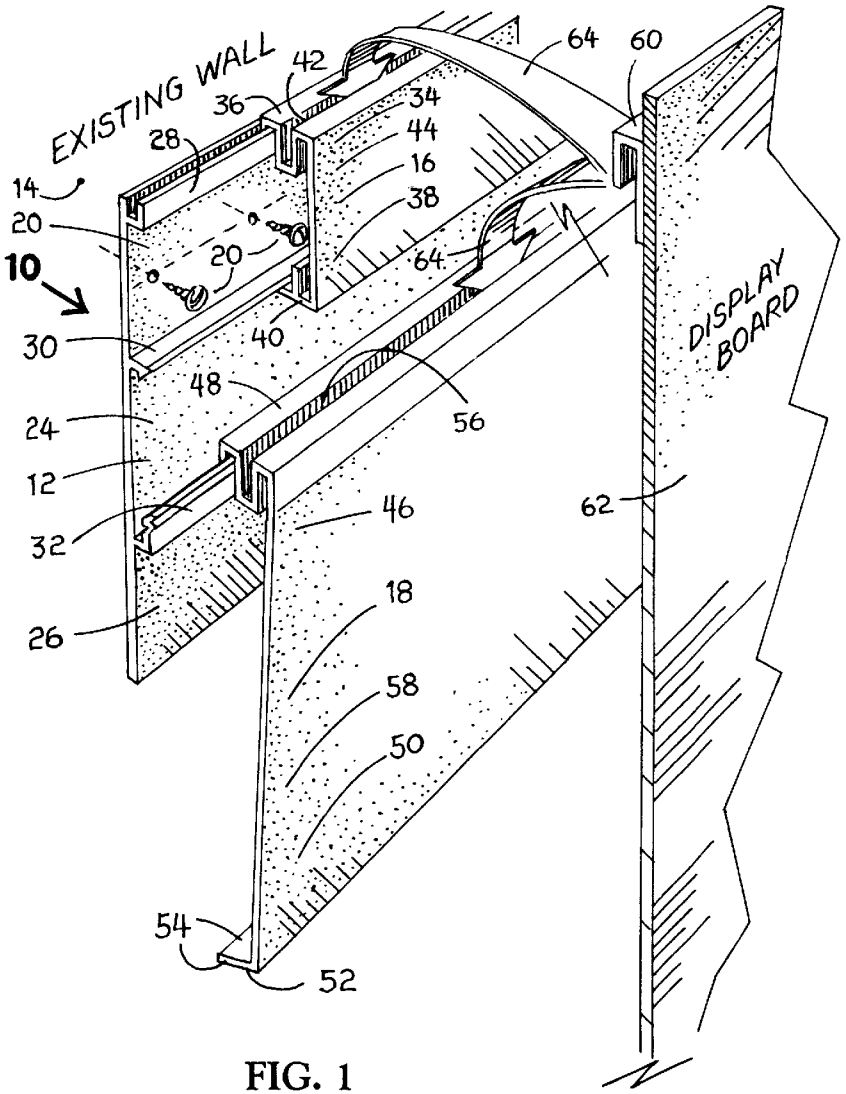
FIG. 1 is a perspective view of the subject three dimensional striping system with a wall bracket mounted on an existing wall. A first profile member and a second profile member are shown releasably attached to a front of the wall bracket. Also shown is a portion of a display board with a display board bracket positioned for receipt in a bracket groove in a top of the first profile member or in a top of the second profile member.

In FIG. 1, a perspective view of the subject three dimensional striping system is shown and having a general reference numeral 10. The striping system 10 broadly includes a wall bracket 12 mounted on an existing wall 14, a first profile member 16 and a second profile member 18. The profile members 16 and 18 are also called rails and the subject invention is known in the trade by a brand name "LOGO RAIL" adopted by the subject inventor.

In this drawing, the profile members 16 and 18 are shown releasably attached to a front of the wall bracket 12, The back of the wall bracket 12 is shown secured to the wall 14 using screw fasteners 20 or similar types of fasteners.

The wall bracket 12 includes an upper portion 22, a middle portion 24 and a lower portion 26. The upper portion 22 of the wall bracket 12 includes a bracket hanger arm 28 extending outwardly at a right angle therefrom. The middle portion 24 of the wall bracket 12 includes a first bracket snap arm 30 extending outwardly at a right angle. The lower portion 26 of the wall bracket 12 includes a second bracket snap arm 32 which also extends outwardly at a right angle.

The first profile member 16 includes an upper portion 34 having a first profile hanger arm 36 which is used for releasably engaging the bracket hanger arm 28. The first profile member 16 also includes a lower portion 38 with a first profile snap arm 40. The first profile snap arm 40 is used for releasably engaging the first bracket snap arm 30 and holding the first profile member 16 in place and in front of the wall bracket 12. The first profile member 16 also includes a first display board bracket groove 42 along the length of the first profile hanger arm 36. Further, the first profile member 16 includes a flat facing 44. The flat facing has a width in a range of 1 ½ to 2 inches.

The second profile member 18 includes an upper portion 46 having a second profile snap arm 48. The second profile snap arm 48 is used for releasably engaging the second bracket snap arm 32 and holding the second profile member 18 next to the front of the wall bracket 12. The second profile member 18 also includes a lower portion 50 disposed below the lower portion 26 of the wall bracket 12. The lower portion 50 includes a second profile straight arm 52 extending inwardly at right angles thereto. An edge 54 disposed along the length of the straight arm 52 is used to rest against a portion of the wall 14. The second profile member 18 also includes a second display board bracket groove 56 along a length of the second profile snap arm 48.

Further, the second profile member 18 includes a flat facing 58. The flat facing 58 has a width in a range of 5 to 6 inches. The flat facing 44 of the first profile member 16 may, for example, have a color of red. The middle portion 24 of the wall bracket 12, which is exposed to the sight of a viewer when looking at the striping system 10, may, for example, have a color of white. The flat facing 58 of the second profile member 18 may, for example, have a color of blue. Obviously, the wall bracket 12 and the profile members 16 and 18 may have various color patterns as desired by the company, business or individual using the striping system 10.

The first and second display board bracket grooves 42 and 56 are used for releasably receiving a portion of a display board bracket 60 mounted on the back of a display board 62. Arrows 64 are shown indicating that the display board bracket 60 can be received in either the first bracket groove 42 or the second bracket groove 56. A portion of the display board 62 is shown in FIG. 1. The front of the display board 62 is used for display graphics and other types of business information.

Figure 2:
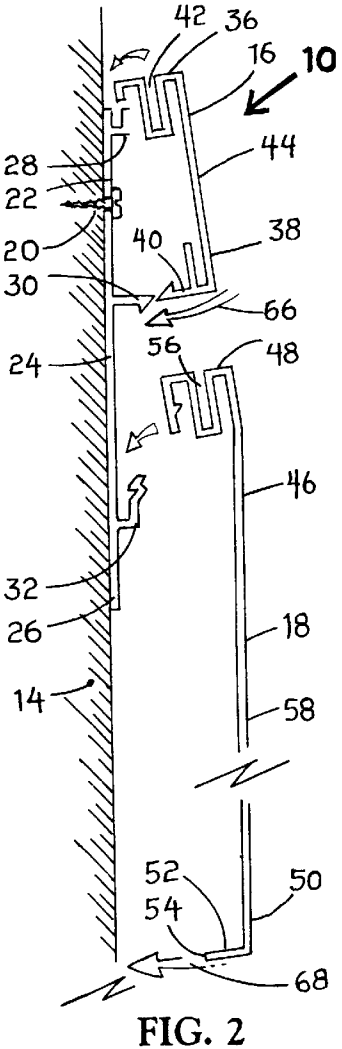
FIG. 2 is a side view of the striping system with the wall bracket mounted on the wall. The first and second profile members are shown positioned for being snapped into place on the front of the wall bracket.

In FIG. 2, a side view of the striping system 10 is shown. In this drawing, a portion of the first profile hanger arm 36 is shown received in the bracket hanger arm 28. Also, the first profile snap arm 40 is shown ready to engage the first bracket snap arm 30 in a snap fit, as indicated by arrow 66. The wall bracket 12 is shown attached to the wall 14.

Also in this view, a portion of the second profile snap arm 48 is shown in a snap fit with the second bracket snap arm 32. The second profile straight arm 52 is shown being lower toward the wall 14, as indicated by arrow 68.

Figure 3:
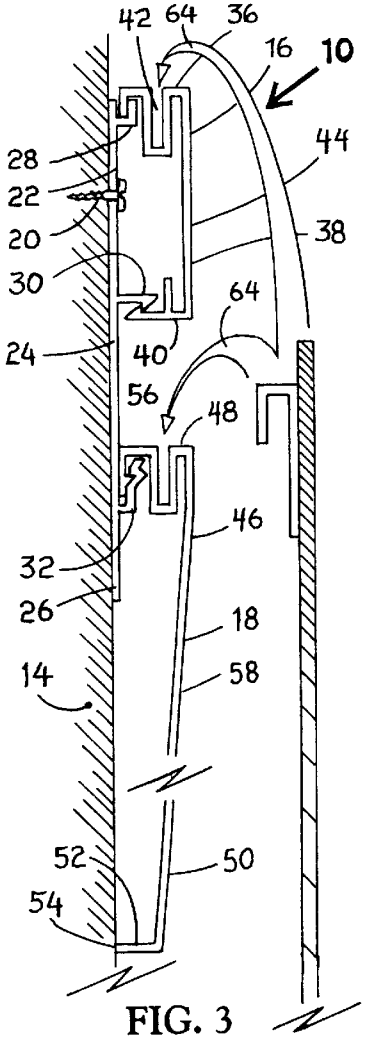
FIG. 3 is another side view of the striping system with the first and second profile members snapped into place and suspended in front of the wall bracket.

In FIG. 3, another side view of the striping system 10 is shown with the first profile member 16 snapped into place on the wall bracket 12. Also, the second profile member 18 is shown snapped into place on the wall bracket 12 with the end 54 of the straight arm 52 resting against the wall 14.

Figure 4:
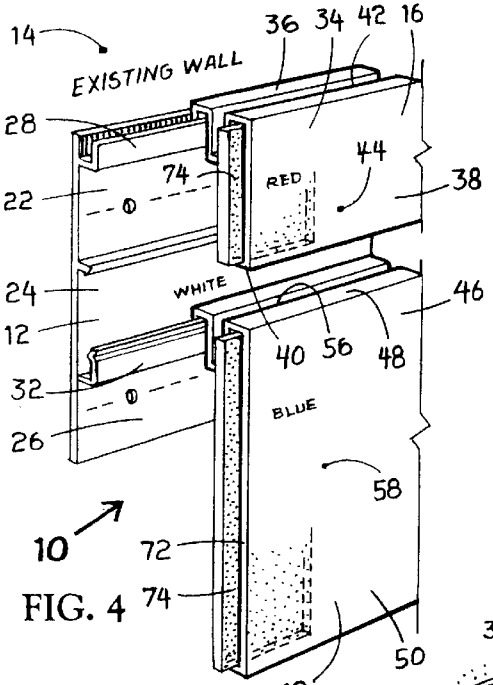
FIG. 4 is another perspective view of the subject three dimensional striping system with one end of the first profile member and the second profile member receiving a portion of a seam gap filler used for joining together two first profile members and two second profile members received on the wall bracket.

In FIG. 4, another perspective view of the subject three dimensional striping system 10 is shown with an end 70 of the first profile member 16 and an end 72 of the second profile member 18 receiving a portion of a pair of couplings or seam gap fillers 74 in openings therein and used for joining together the ends of two first profile members 16 and ends of two second profile members 18 received on the wall bracket 12. The seam gap fillers are colored to match the color of the profile members 16 and 18, so that when the members expand and contract on the wall bracket any seam between the ends of the profile members 16 and 18 is not exposed to a different color of the wall bracket 12 or the color of the wall 14.

Figure 5:
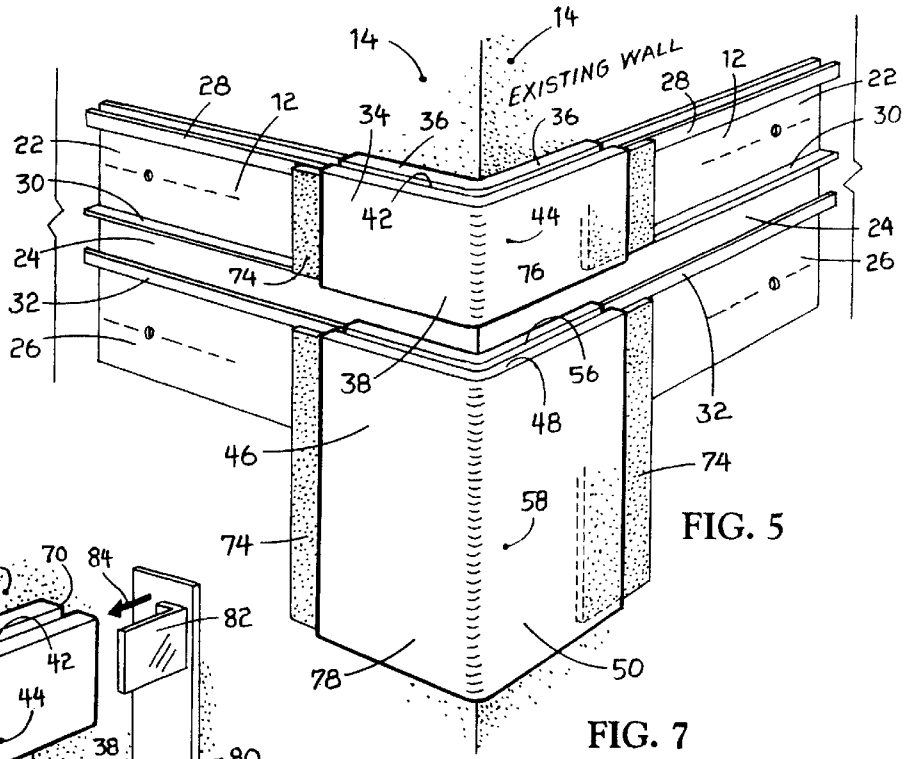
FIG. 5 illustrates a perspective view of a first outside corner profile member and a second outside corner profile member. The two corner profile members are used for engaging ends of the first and second profile members at an outside wall corner.

In FIG. 5, a perspective view of a first outside corner profile member 76 and a second outside corner profile member 78 is illustrated. The two corner profile members 76 and 78 are similar in structure and function when compared to the first and second profile members 16 and 18. The corner profile members 76 and 78 are used for engaging ends 70 and 72 of the first and second profile members 16 and 18 at an outside wall corner of the wall 14. Note, the opposite ends of the first and second corner profile members 76 and 78 include seam gap fillers 74 extending outwardly therefrom for inserting into the ends 70 and 72 of the first and second profile members 16 and 18. Obviously, if inside corner profile members were required for use with the stripping system 10, they would be similar in structure to the outside corner profile members 76 and 78 but bent inwardly for an inside corner rather than bent outwardly for an outside corner. An inside corner profile member is not shown in the drawings.

Figure 6:
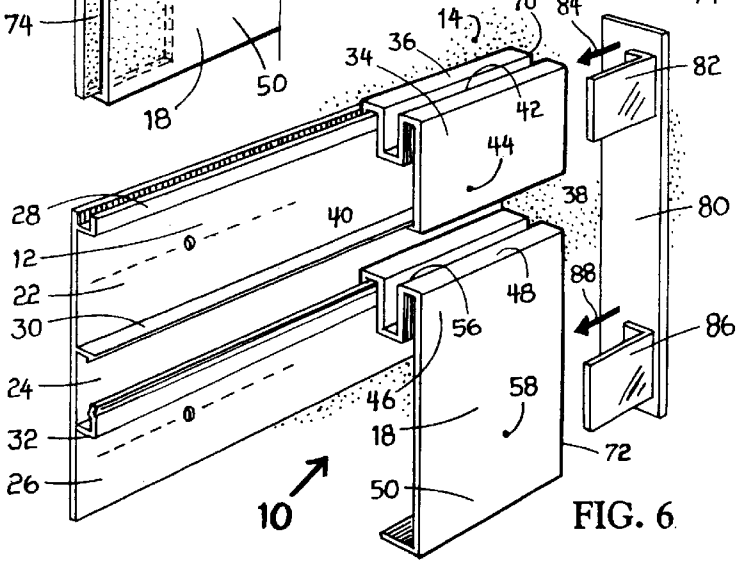
FIG. 6 illustrates a perspective view of a right hand or left hand profile end closure used for engaging and covering the ends of the first and second profile members.

In FIG. 6, a perspective view of a right hand profile end closure member 80 is shown and used for engaging and covering the ends 70 and 72 of the first and second profile members 16 and 18. A left hand profile end closure member would be similar in structure to the right hand profile end closure member 80. The left hand profile end closure member is not shown in the drawings. The right hand profile end closure member 80 includes an upper flange 82 for inserting into an opening in the end 70 of the first profile member 16 in a press fit as indicated by arrow 84. The end closure member 80 also includes a lower flange 86 for inserting into an opening in the end 72 of the second profile member 18 in a press fit as indicated by arrow 88. The profile end closure member 80 is used to cover the opposite ends of the stripping system 10 for a neat, clean and streamlined appearance.

Figure 7:
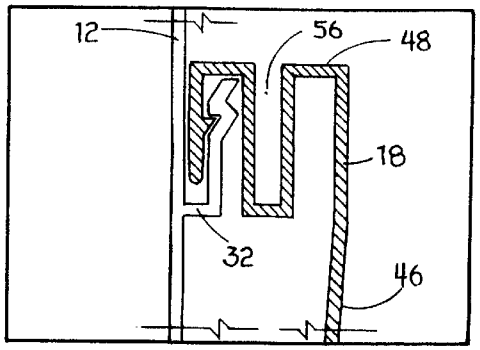
FIG. 7 is a sectional view of an upper portion of the second profile member attached to the second bracket snap arm.

In FIG. 7, a sectional view of the upper portion 46 of the second profile member 18 is shown attached to the second bracket snap arm 32 in a tight snap fit. Note, the snap arm 32 has a zigzag shape for holding the second profile member 18 tightly thereagainst and to prevent rocking of the member 18 thereon. Also, the upper portion 46 of the second profile member 18 is slightly bent inwardly toward the existing wall 14 so that when the member 18 is installed, the edge 54 of the second profile straight arm 52 hugs the wall 14 as shown in FIG. 3.

While the invention has been shown, described and illustrated in detail with reference to the preferred embodiments and modifications thereof, it should be understood by those skilled in the art that equivalent changes in form and detail may be made therein without departing from the true spirit and scope of the invention as claimed, except as precluded by the prior art.

The embodiments of the invention for which an exclusive privilege and property right is claimed are defined as follows:

1. A three dimensional wall mounting striping system adapted for mounting on a wall, the striping system comprising:

a wall bracket, said wall bracket adapted for mounting on the wall, said wall bracket including a bracket banger arm, a first bracket snap arm and a second bracket snap arm;

a first profile member, said first profile member including a first profile hanger arm said first profile hanger arm releasably engaging said bracket hanger arm said first profile member including a first profile snap arm, said first profile snap arm releasably engaging said bracket snap arm; and a second profile member having an upper portion and a lower portion, the upper portion including a second profile snap arm, said second profile snap arm releasably engaging said second bracket snap arm, the lower portion of said second profile member extending below a lower portion of said wall bracket and spaced away from and unconnected from said wall bracket, the lower portion of said second profile member including a second profile straight arm, an edge along a length of said second profile straight arm adapted to rest against a portion of the wall and whereby said second profile member has a profile causing said edge to hug the wall.

2. The striping system as described in claim 1 further including a first display board bracket groove along a length of said first profile hanger arm.

3. The striping system as described in claim 1 further including a second display board bracket groove along a length of said second profile snap arm.

4. A three dimensional wall mounting striping system adapted for mounting on a wall, the striping system comprising:

a wall bracket, said wall bracket adapted for mounting on the wall, said wall bracket including an upper portion, a middle portion and a lower portion, the upper portion of said wall bracket including a bracket hanger arm, the middle portion of said wall bracket includes a first bracket snap arm, the lower portion of said wall bracket including a second bracket snap arm;

a first profile member, said first profile member including an upper portion having a first profile hanger arm, said first profile hanger arm releasably engaging said bracket hanger arm, said first profile member including a lower portion with a first profile snap arm, said profile snap arm releasably engaging said first bracket snap arm; and a second profile member including an upper portion having a second profile snap arm, said second profile snap arm releasably engaging said second bracket snap arm, said second profile member including a lower portion having a second profile straight arm, the lower portion of said second profile member extending below a lower portion of said wall bracket and spaced away from and unconnected from said wall bracket, the lower portion of said second profile member angled inwardly from a vertical and toward the wall, an edge along a length of said second profile straight arm adapted to rest against a portion of the wall and whereby said second profile member has a profile causing said edge to hug the wall.

5. The striping system as described in claim 4 further including a first display board bracket groove along a length of a top of an upper portion of said first profile hanger arm.

6. The striping system as described in claim 4 further including a second display board bracket groove along a length of a top of an upper portion of said second profile snap arm.

7. The striping system as described in claim 4 further including seam gap fillers for receipt in openings in ends of said first and second profile members for coupling together a plurality of first and second profile members on said wall bracket.

8. The striping system as described in claim 4 further including a first corner profile member used for engaging an end of said first profile member and a second corner profile member used for engaging an end of said second profile member when said wall bracket is mounted next to a corner in a wall.

9. The striping system as described in claim 4 further including a profile end closure member used for engaging in a snap fit ends of said first and second profile members.

10. A three dimensional wall mounting striping system adapted for mounting on a wall, the striping system also adapted for receiving a display board bracket thereon, the display board bracket mounted on the back of a display board, the striping system comprising:

a wall bracket, said wall bracket adapted for mounting on the wall, said wall bracket including an upper portion, a middle portion and a lower portion, the upper portion of said wall bracket including a bracket hanger arm, the middle portion of said wall bracket includes a first bracket snap arm, the lower portion of said wall bracket including a second bracket snap arm;

a first profile member, said first profile member including an upper portion having a first profile hanger arm, said first profile hanger arm releasably engaging said bracket hanger arm, said first profile hanger arm having a first display board bracket groove along a length thereof and adapted for receiving a portion of the display board hanger therein, said first profile member including a lower portion with a first profile snap arm, said first profile snap arm releasably engaging said first bracket snap arm; and a second profile member including an upper portion having a second profile snap arm, said second profile snap arm releasably engaging said second bracket snap arm, said second profile hanger arm having a second display board bracket groove along a length thereof and adapted for receiving a portion of the display board hanger therein, said second profile member including a lower portion having a second profile straight arm, the lower portion of said second profile member extending below a lower portion of said wall bracket and spaced away from and unconnected from said wall bracket, the lower portion of said second profile member angled inwardly from a vertical and toward the wall, an edge along a length of said second profile straight arm adapted to rest against a portion of the wall and whereby said second profile member has a profile causing said edge to hug the wall.

11. The striping system as described in claim 10 further including a plurality of seam gap fillers, said seam gap fillers received in openings in ends of said first and second profile members for coupling together a plurality of first and second profile members on said wall bracket.

12. The striping system as described in claim 10 further including a first outside corner profile member used for engaging an end of said first profile member and a second outside corner profile member used for engaging an end of said second profile member when said wall bracket is mounted next to an outside corner in a wall.

13. The striping system as described in claim 10 further including a first inside corner profile member used for engaging an end of said first profile member and a second inside corner profile member used for engaging an end of said second profile member when said wall bracket is mounted next to an outside corner in a wall.

14. The striping system as described in claim 10 further including a profile end closure member having an upper and lower flange mounted thereon, the flanges used for engaging an inside of the ends of said first and second profile members in a snap fit.

* * * * *